US010529275B2

(12) United States Patent
Song

(10) Patent No.: US 10,529,275 B2
(45) Date of Patent: Jan. 7, 2020

(54) METHOD AND DEVICE FOR LUMINANCE ADJUSTMENT, DISPLAY DEVICE, AND COMPUTER-READABLE STORAGE MEDIUM

(71) Applicant: BOE Technology Group Co., Ltd., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/117,412

(22) Filed: Aug. 30, 2018

(65) Prior Publication Data

US 2019/0295462 A1 Sep. 26, 2019

(30) Foreign Application Priority Data

Mar. 26, 2018 (CN) ..... 2018 1 0253243

(51) Int. Cl.
*G09G 3/3208* (2016.01)
*G09G 3/20* (2006.01)

(52) U.S. Cl.
CPC ..... *G09G 3/3208* (2013.01); *G09G 3/2096* (2013.01); *G09G 2310/08* (2013.01);
(Continued)

(58) Field of Classification Search
CPC ..... G09G 3/3406; G09G 3/3208; G09G 2360/16; G09G 2320/0626;
(Continued)

(56) References Cited

U.S. PATENT DOCUMENTS

2009/0257678 A1* 10/2009 Chen ..... G09G 5/10 382/274
2009/0262057 A1* 10/2009 Yoon ..... G09G 3/3406 345/89

(Continued)

FOREIGN PATENT DOCUMENTS

CN 101651806 A 2/2010
CN 101814267 A 8/2010

(Continued)

OTHER PUBLICATIONS

First office action of Chinese application No. 201810253243.4 dated Sep. 2, 2019.

*Primary Examiner* — Dong Hui Liang
(74) *Attorney, Agent, or Firm* — Fay Sharpe LLP

(57) ABSTRACT

A method and a device for luminance adjustment, and a display device are provided. The luminance adjustment method includes: receiving an image data signal; and performing luminance adjustment on a dynamic image according to a target adjustment mode when a received image data signal belongs to the dynamic image, wherein the target adjustment mode is a luminance adjustment corresponding to a sum of luminance components in the image data signal among the plurality of adjustment modes; the plurality of adjustment modes includes a first mode, a second mode and a third mode, the range of luminance adjustment based on the second mode is between the one based on the first mode and the one based on the third mode. With the luminance adjustment method and device, the image flickering in displaying a dynamic image may be reduced.

20 Claims, 5 Drawing Sheets

(52) U.S. Cl.
CPC ..... *G09G 2320/0247* (2013.01); *G09G 2320/0626* (2013.01); *G09G 2340/06* (2013.01)

(58) Field of Classification Search
CPC ... G09G 2320/0646; G09G 2320/0686; G09G 2330/021
See application file for complete search history.

(56) References Cited

U.S. PATENT DOCUMENTS

| | | | | |
|---|---|---|---|---|
| 2010/0013871 | A1* | 1/2010 | Shen | G09G 3/3406 345/691 |
| 2010/0253664 | A1 | 10/2010 | Byun et al. | |
| 2014/0085170 | A1* | 3/2014 | Park | G09G 5/02 345/83 |
| 2017/0186357 | A1 | 6/2017 | Zeng et al. | |

FOREIGN PATENT DOCUMENTS

| | | | |
|---|---|---|---|
| CN | 105225634 | A | 1/2016 |
| CN | 106297657 | A | 1/2017 |
| CN | 106548763 | A | 3/2017 |

* cited by examiner

METHOD AND DEVICE FOR LUMINANCE ADJUSTMENT, DISPLAY DEVICE, AND COMPUTER-READABLE STORAGE MEDIUM

This application claims priority to Chinese Patent Application No. 201810253243.4, filed with the State Intellectual Property Office on Mar. 26, 2018 and titled "METHOD AND DEVICE FOR LUMINANCE ADJUSTMENT, AND DISPLAY DEVICE", the entire contents of which are incorporated herein by reference.

TECHNICAL FIELD

The present disclosure relates to a method and a device for luminance adjustment, a display device, and a computer-readable storage medium.

BACKGROUND

An electroluminescence device is a kind of a self-luminous display device, which attracts common attention due to its wide viewing angle, high contrast and high response speed. With the growth of electroluminescence technologies, compared with inorganic electroluminescence devices, organic electroluminescence devices, such as organic light emitting diodes (OLED), can provide better luminance, lower power consumption, higher response speed and better color gamut, making them one of the mainstream devices in the current display market.

SUMMARY

There are provided a method and a device for luminance adjustment, a display device, and a computer-readable storage medium in the present disclosure.

In a first aspect, there is provided a luminance adjustment method, comprising:

receiving an image data signal; and performing a luminance adjustment on a dynamic image according to a target adjustment mode when the received image data signal belongs to the dynamic image, wherein the target adjustment mode is an adjustment mode corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of luminance adjustment according to the first mode is larger than a range of luminance adjustment according to the second mode, and the range of luminance adjustment according to the second mode is smaller than a range of luminance adjustment according to the third mode.

In a possible implementation, the luminance adjustment method further comprises:

performing the luminance adjustment on a static image according to a duration of displaying the static image when the received image data signal belongs to the static image, to make luminance of the static image decrease gradually with an increase of the duration of displaying the static image.

In a possible implementation, the luminance adjustment method further comprises:

calculating the sum of the luminance components in the image data signal;

determining whether the image data signal belongs to one of the static image and the dynamic image by judging whether the sum of the luminance components in the image data signal is the same as that in a previous frame.

In a possible implementation, the performing the luminance adjustment on the dynamic image according to the target adjustment mode when the received image data signal belongs to the dynamic image, comprises:

performing the luminance adjustment on the dynamic image according to the target adjustment mode, when the sum of the luminance components in the image data signal is different from that in the previous frame.

In a possible implementation, at least one of the plurality of adjustment modes uses a piecewise linear transformation method to perform the luminance adjustment.

In a possible implementation, the performing the luminance adjustment on the dynamic image according to the target adjustment mode comprises:

performing the luminance adjustment on the dynamic image by outputting a control signal to a gamma circuit.

In a possible implementation, the luminance adjustment according to the first mode is a luminance adjustment for increasing the luminance, the luminance adjustment according to the second mode is a luminance adjustment for keeping the luminance unchanged, and the luminance adjustment according to the third mode is a luminance adjustment for decreasing the luminance.

In a second aspect, there is provided a display device, comprising:

a display interface configured to receive an image data signal; and a controller connected to the display interface, wherein the controller is configured to:

perform a luminance adjustment to a dynamic image according to a target adjustment mode when a received image data signal belongs to the dynamic image, wherein the target adjustment mode is a luminance adjustment corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of the luminance adjustment according to the first mode is larger than a range of luminance adjustment according to the second mode, and the range of luminance adjustment according to the second mode is smaller than a range of luminance adjustment according to the third mode.

In a possible implementation, the controller is configured to:

perform the luminance adjustment on the static image according to a duration of displaying the static image when the received image data signal belongs to the static image, to make luminance of the static image decrease gradually with an increase of the duration of displaying the static image.

In a possible implementation, the controller determines whether the image data signal belongs to one of the static image and the dynamic image by judging whether the sum of the luminance components in the image data signal is the same as that in a previous frame.

In a possible implementation, at least one of the plurality of adjustment modes uses a piecewise linear transformation method to perform the luminance adjustment.

In a possible implementation, the display device further comprises a gamma circuit connected to the controller, and the controller performs the luminance adjustment on the dynamic image by outputting a control signal to the gamma circuit.

In a possible implementation, the luminance adjustment according to the first mode is a luminance adjustment for increasing the luminance, the luminance adjustment according to the second mode is a luminance adjustment for keeping the luminance unchanged, and the luminance adjustment according to the third mode is a luminance adjustment for decreasing the luminance.

In a possible implementation, the display device further comprises a timing control circuit connected to the controller, and the controller receives a RGB data signal through the display interface and sends a EGBW data signal converted from the RGB data signal to the timing control circuit.

In a third aspect, there is provided a luminance adjustment device, comprising:

a receiving circuit configured to receive an image data signal;

a first adjustment circuit configured to perform a luminance adjustment on a dynamic image according to a target adjustment mode when the received image data signal belongs to the dynamic image, wherein the target adjustment mode is an adjustment mode corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of luminance adjustment according to the first mode is larger than a range of luminance adjustment according to the second mode, and the range of luminance adjustment according to the second mode is smaller than a range of luminance adjustment according to the third mode.

In a possible implementation, the luminance adjustment device further comprises:

a second adjustment circuit configured to perform the luminance adjustment on the static image according to a duration of displaying the static image when the received image data signal belongs to the static image, to make luminance of the static image decrease gradually with an increase of the duration of displaying the static image.

In a possible implementation, the luminance adjustment device further comprises:

a calculating circuit configured to calculating the sum of the luminance components in the image data signal; and a determining circuit configured to determine whether the image data signal belongs to one of the static image and the dynamic image by judging whether the sum of the luminance components in the image data signal is the same as that in a previous frame.

In a possible implementation, the first adjustment circuit is further configured to:

perform the luminance adjustment on the dynamic image according to the target adjustment mode, when the sum of the luminance components in the image data signal is different from that in the previous frame.

In a fourth aspect, there is provided a computer-readable storage medium storing instructions that, when executed by a computer, cause the computer to perform any one of the foregoing methods.

DETAILED DESCRIPTION

The embodiments of the present disclosure will be described in details with reference to the enclosed drawings. Obviously, the embodiments presented here are only some but not all embodiments of the present disclosure. On the basis of the embodiments of the present disclosure, all other embodiments obtained by those skilled in the art without creative works shall fall into the protection scope of the present disclosure. Unless otherwise defined, technical terms or scientific terms used in the present disclosure should have the ordinary meaning understood by those of ordinary skill in the art. The terms "first", "second" and similar terms used in the present disclosure do not denote any order, quantity, or importance, and are merely used to distinguish different components. The term "comprise" or similar terms mean that elements or objects appearing before the term cover the listed elements or objects and its equivalents appearing after the term, without excluding other elements or objects. The term "connected" or "coupled" and similar terms are not limited to physical or mechanical connections, and may include electrical connection which can be direct or indirect.

It can be noted that, an organic light-emitting diode (OLED) display device often uses a peak luminance control (PLC) algorithm to adjust luminance according to a display image. For example, the above-mentioned PLC method can be realized by changing gamma voltage according to the average picture level (APL) calculated based on the luminance components of RGB sub-pixels. However, due to presence of the PLC algorithm, when a dynamic image is displayed, there may be flickering phenomenon caused by large difference between contents displayed in 2 adjacent frames, resulting in an adverse influence to visual effects.

Figure 1:
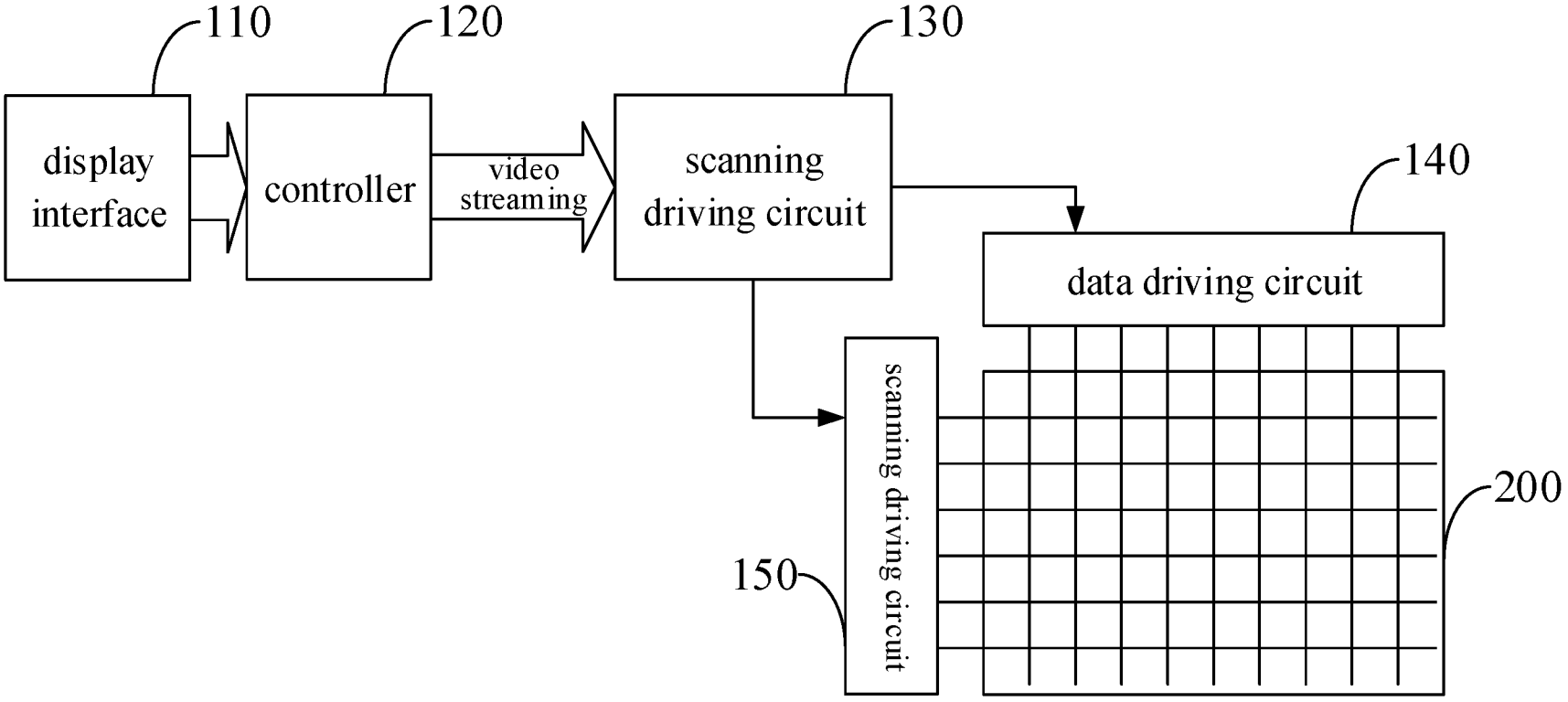
FIG. 1 is a schematic diagram of an architecture of a display driving system according to an embodiment of the present disclosure.

FIG. 1 is a schematic diagram of an architecture of a display driving system in an embodiment of the present disclosure. Referring to FIG. 1, the system mainly comprises a display interface 110, a controller 120 (also referred to an image controller), a timing control circuit 130, a data driving circuit 140, a scanning driving circuit 150 and a display area circuit 200 (the structure included in the display driving system may be not limited hereto). In an example of a display driving process, the controller 120 receives an image controlling signal from outside via the display interface 110, and the controller 120 transmits a video streaming to the timing control circuit 130 via a display interface based on embedded Display Port (eDP) standards. A transmitted video streaming contains frames of image data sorted in the order of frame frequencies, such as 120 Hz, 60 Hz, 30 Hz etc. The timing control circuit 130 receives the video streaming from the controller 120 via the display interface, and then outputs each frame of image data in the video streaming in the order of frame frequencies. In an example of a process of outputting image data by the timing control circuit 130, the timing control circuit 130 transmits a data signal generated based on image data to the data driving circuit 140, and also transmits the timing control signals synchronized with each other to the data driving circuit 140 and the scanning driving circuit 150 respectively, to make both of the data driving circuit 140 and the scanning driving circuit 150 output a driving signal to the display area circuit 200 in a collaborative way, write a data voltage into each pixel frame by frame, as well as refresh each frame on the display panel. It is to be understood that the display panel can only include the display area circuit 200 in the above display driving system, or can additionally include any one or more of the controller 120, the timing control circuit 130, the data driving circuit 140 and the scanning driving circuit 150. For example, the display panel can include the display area circuit 200 inside the display area and the scanning driving circuit 150 outside the display area, or can additionally include a circuit board provided with the timing control circuit 130 and the data driving circuit 140.

Figure 2:
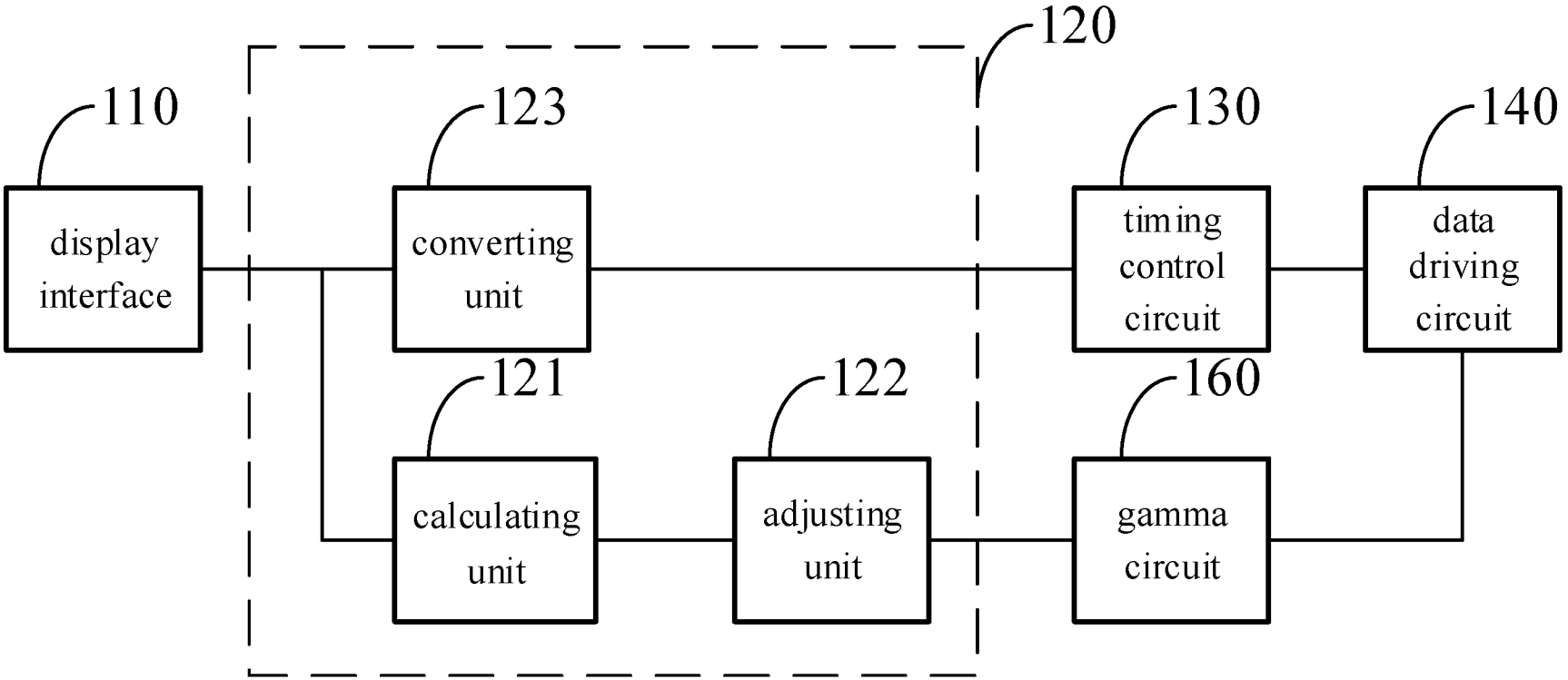
FIG. 2 is a block diagram of a structure of a display device according to an embodiment of the present disclosure.

FIG. 2 is a block diagram of a structure of a display device provided in an embodiment of the present disclosure. It should be noted that the display device can be any product or component with display functions such as a display panel, a mobile phone, a tablet, a TV set, a monitor, a notebook, a digital photo frame or a navigator, or any display device of OLED (organic light-emitting diode) type or QLED (quantum dot light-emitting diode) type.

The display device shown in FIG. 2 includes a display interface 110, a controller 120, a timing control circuit 130, a data driving circuit 140 and a gamma circuit 160. It should be understood that FIG. 2 mainly shows the part of the display device used for receiving image data signal to drive display. The display device can also include other parts not shown in FIG. 2 to perform expected functions, such as include the scanning driving circuit 150 and the display area circuit 200 mentioned above for performing display driving. In the present embodiment, the controller 120 connected with the display interface 110 is configured to perform luminance adjustment on a dynamic image according to a target adjustment mode when the received image data signal belongs to the dynamic image, where the target adjustment mode is an adjustment mode corresponding to a sum of the luminance components in the image data signal among a plurality of adjustment modes. In an example, the plurality of adjustment modes include a first mode, a second mode and a third mode, and the sums of the luminance components respectively corresponding to the first mode, the second mode and the third mode sequentially increased. Additionally, the range of luminance adjustment based on the first mode is larger than the range of luminance adjustment based on the second mode, and the range of luminance adjustment based on the second mode is smaller than the range of luminance adjustment based on the third mode.

Figure 3:
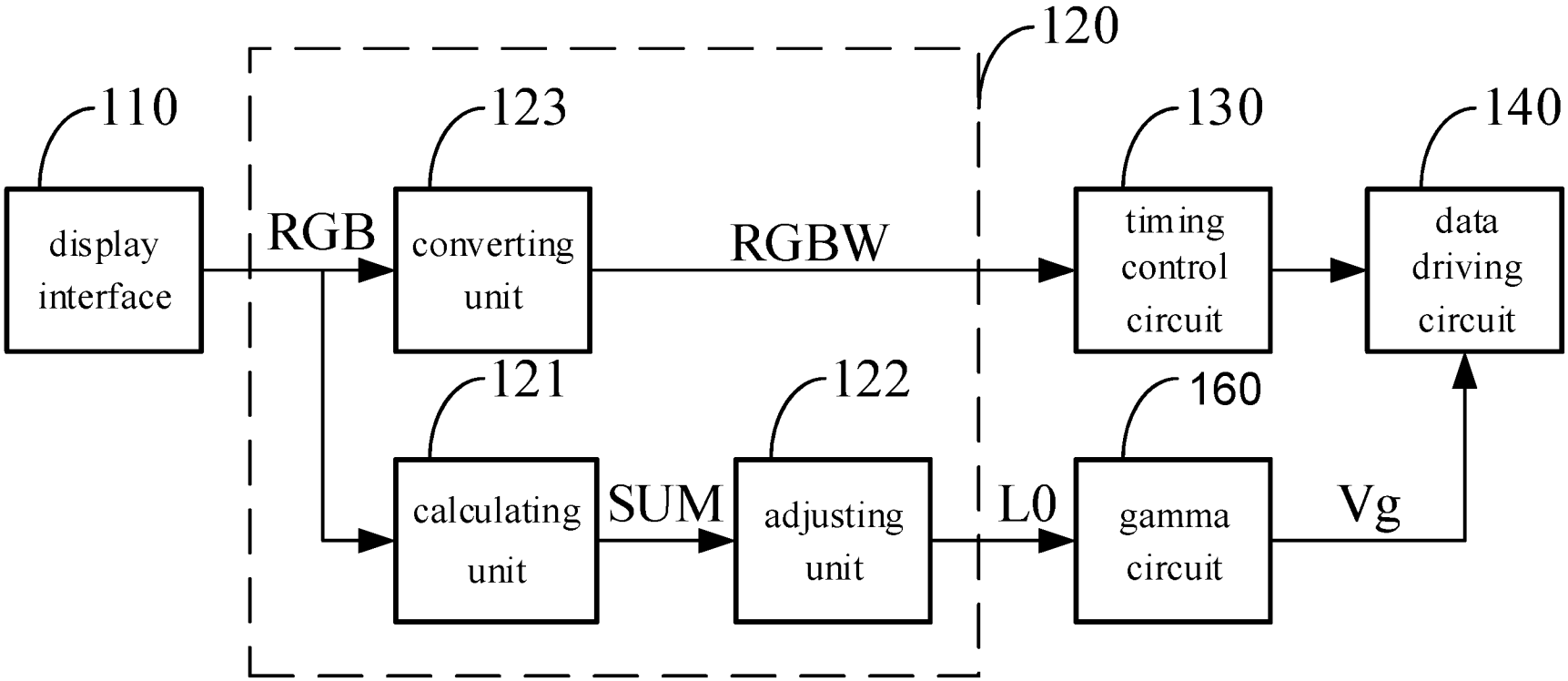
FIG. 3 is a signal-flow diagram when a luminance adjustment is performed on the display device shown in FIG. 2.

Referring to FIG. 2, the controller 120 performing luminance adjustment on the dynamic image by outputting a control signal to the gamma circuit 160 in the present embodiment is taken as an example to illustrate the process of performing luminance adjustment on the dynamic image. In the example, the controller 120 includes a calculating unit 121, an adjusting unit 122 and a converting unit 123. FIG. 3 shows the signal-flow diagram when a luminance adjustment is performed on the display device shown in FIG. 2. Referring to FIG. 3, an image data signal (RBG data signal) received via the display interface 110 is input, frame by frame, into the calculating unit 121 and the converting unit 123. The calculating unit 121 calculates the sum (SUM) of the luminance components in the RGB data signal of each frame, and input SUM into the adjusting unit 122 for luminance adjustment. The converting unit 123 converts the RGB data signal into an RGBW data signal, and sends it to the timing control circuit 130 to drive the display of the panel including RGBW sub-pixels.

As a simplified example, a frame of RGB data signal includes data of 4 pixels which are (R0, G0, B0), (R1, G1, B1), (R2, G2, B2) and (R3, G3, B3). The calculating unit 121 firstly converts data of the 4 pixels, based on a conversion relation between the RGB color model and the YUV (also called YCbCr) color model, into YUV format: (Y0, U0, V0), (Y1, U1, V1), (Y2, U2, V2), (Y3, U3, V3), and then calculates the sum of luminance components: SUM=Y0+Y1+Y2+Y3. In an example, the calculating unit 121 performs a calculation to obtain Y0, Y1, Y2 and Y3 directly according to the conversion relation of Y=0.299R+0.587G+0.114B, and gets the SUM value by sum calculation. In comparison, the display device in the previous example can make use of an integrated standard YUV converting module to realize the calculating unit 121, without the trouble of creating a separate operation relation, while the display device in the latter example does not need the conversion calculation of U coordinate and V coordinate, thus the algorithm efficiency can be improved. Of course, the implementation of the calculating unit 121 may not be limited to the above examples.

The converting unit 123 is mainly used for converting an RGB data signal into an RGBW data signal, so as to drive the display of panel including RGBW sub-pixels. This can be achieved by using a related conversion algorithm which is not explained in details here. It should be noted that the converting unit 121 can, but is not limited to, perform conversion from the RGB data signal into the RGBW data signal independently of the adjusting unit 122, or adjust value of W coordinate under control of the adjusting unit 122 to perform luminance adjustment.

In FIG. 3, the adjusting unit 122 generates a control signal L0 based on the sum of the luminance components (SUM) in the above RGB data signal, and controls, frame by frame, magnitude of gamma voltage (Vg) output from the gamma circuit 160 to the data driving circuit 140 via the control signal L0. It should be understood that the gamma circuit 160 is a circuit structure (for example, P-Gamma chip) for performing gamma correction on displayed image in the display device, and the data driving circuit 140 is controlled by the gamma voltage (Vg) provided from the gamma circuit 160 and adjusts luminance of the displayed image accordingly. For example, a digital-analogue converter in the data driving circuit 140 can determine the reference level during conversion according to magnitude of gamma voltage (Vg), and thus realize luminance adjustment on the image without changing RGBW data signal which belongs to a digital signal.

In an example of the luminance adjustment method, the adjusting unit 122 firstly determine, based on the SUM value, if the image data signal in current frame belongs to a static image or a dynamic image, and then use different luminance adjustment modes in these 2 different situations. For example, the sum (SUM0) of luminance components in the RGB data signal of the previous frame can be stored in the adjusting unit 122. If the SUM0 value is the same as the SUM value, the image data signal in the current frame belongs to a static image. If the SUM0 value is different from the SUM value, the image data signal in the current frame belongs to a dynamic image. After obtaining this result, the SUM is used to overwrite the SUM0 for the determination of the next frame. It should be understood that, according to the application requirements, a more refined or rough method can be used to determine a static image and a dynamic image. For example, a method of randomly taking several pixel points as samples to observe whether the image data signal changes, and the like. Compared with other determining methods, the determination based on the SUM of the current frame does not require additional calculation of other parameter values, which is advantageous for improving processing efficiency.

In an example of luminance adjustment on a dynamic image, the luminance adjustment based on the first mode increases the luminance, the luminance adjustment based on the second mode keeps the luminance unchanged, and the luminance adjustment based on the third mode decreases the luminance. In other words, the first mode can increase the overall luminance of the dynamic image, the second mode can keep the overall luminance of the dynamic image unchanged, and the third mode can decrease the overall luminance of the dynamic image. It should be noted that the "increasing the luminance" doesn't require that the luminance of each image unit needs to be increased. Instead, due to difference of image data signals, the luminance of some image units may be decreased (but the overall luminance of the image may be increased because the luminance of other image units increases), or the overall luminance of the image remains unchanged (all image data signals in the image don't require the adjustment of luminance). It is the similar case for "keeping the luminance unchanged" and "decreasing the luminance".

In an example, the luminance adjustment to a dynamic image is performed by applying the same luminance coefficient to each pixel or sub-pixel in the whole image, which means that compared with the luminance (L) prior to adjustment, the adjusted luminance (L') of each image unit in the dynamic image satisfies the numerical relation of $L'=k\cdot L$, where k is the luminance coefficient. Therefore, the first mode can correspondingly set the luminance coefficient (k1) value to be larger than 1, the second mode can correspondingly set the luminance coefficient (k2) value to be equal or close to 1, while the third mode can correspondingly set the luminance coefficient (k3) value to be smaller than 1. Consequently, it is possible to determine, based on the range of SUM value of current frame, that which luminance coefficient (k1, k2 or k3) is used for luminance adjustment to the dynamic image of current frame.

In an example, the adjustment mode is determined based on a ratio between SUM value of current frame and maximum luminance component value (MAX), where MAX is the maximum value of SUM in all possible cases. For example, in the case where a frame of RGB data signal includes 4 pixels, when the maximum value of Y coordinator in YUV color model is 255, the MAX value is $4\times255=1020$, while the value of SUM/1020 determines which adjustment mode will be used for luminance adjustment of the dynamic image.

In an example, the luminance adjustment is performed according to the first mode if the value of SUM/MAX falls in the range of [0, 20%), performed according to the second mode if the value of SUM/MAX falls in the range of [20%, 60%), and performed according to the third mode if the value of SUM/MAX falls in the range of [60%, 100%]. Thus, applying the first mode in a darker image can increase the luminance of the image, applying the third mode in a brighter image can decrease luminance and display power consumption, while applying the second mode in other normal situations can keep the display effect unchanged. It should be understood that in most cases, the sum of luminance components of a general dynamic image falls in the middle range. So in most cases, the adjustment mode will be kept in the second mode, thereby reducing image flickering caused by luminance adjustment while performing luminance adjustment, and ensuring a good display effect.

In a comparison example, the luminance adjustment to an image is performed based on the Average Picture Level (APL) of an RGB image data signal. During adjustment, a luminance gain is calculated by using the average luminance values of several adjacent frames, and then is used for luminance adjustment of these frames. In this way, the range of luminance adjustment of adjacent frames is limited, reducing image flickering caused by difference of adjustment ranges. When the luminance adjustment is performed according to this comparison example, however, the luminance gain occasionally changes suddenly while the overall luminance of adjacent frames is similar to each other. These sudden changes may cause visual flickering (sudden brightening or darkening) of image and affect display effect. To resolve this issue, in the related art, the image flickering can be weakened by making the luminance of adjacent frames consistent. However, this method will also decrease the contrast of adjacent frames, which means that the enhancement of display effect is achieved by decreasing dynamic contrast. Compared with this comparison example, the embodiments of the present disclosure remain effects of luminance adjustment by dividing the adjustment modes, while avoid sudden change of luminance adjustment range in most cases where the luminance value falls in the middle range, preventing image flickering in these cases. Additionally, it is observed that compared with the luminance adjustment algorithm used in the related art which achieves enhancement of display effect and/or reduced power consumption by decreasing dynamic contrast, the present disclosure can reduce power consumption and enhance display effect without excessive influence on dynamic contrast, so that the dynamic contrast can be increased relatively, which is help to enhance display effect and reduce displaying power consumption.

It should be noted that the range of SUM/MAX values can be set in combination with the application requirement on the displaying power consumption. For example, for the application requirement in which the maximum displaying power consumption is limited within 300 W, if the displaying power consumption reaches about 290 W when the actual tested SUM/MAX is 65%, the SUM/MAX threshold value between second mode and third mode can be set as 65%, so that a luminance coefficient of k3 less than 1 is applied to dynamic image when SUM/MAX is larger than 65%, ensuring that the displaying power consumption of display device doesn't exceed the required level.

It should also be noted that at least one of the abovementioned several adjustment modes can use a piecewise linear transformation method to perform luminance adjustment, and don't have to use the method of uniformly applying the same luminance coefficient. For example, the second mode can apply the luminance coefficient k3 less than 1 to luminance components (Y coordinate value) which are larger than 245 in image data signal, and apply the luminance coefficient k2 equal or close to 1 to other components, to prevent local displaying power consumption from exceeding the requirement. Of course, the specific implementation of luminance adjustment may be not only limited to the presented examples.

In an example of performing luminance adjustment on a static image, the controller performs luminance adjustment on the static image according to a duration of displaying the static image when a received image data signal belongs to the static image, so as to make luminance of the static image decrease gradually with the increase of duration of displaying the static image. In other words, no matter which range the luminance of the static image is within, the luminance adjustment will make the luminance decrease gradually with the increase of duration of displaying the static image, so as to reduce power consumption for displaying the static image. In an example, the duration tmax (from a time that the luminance of the static image starts decreasing to a time that the luminance remains as a stable value) can be preset, and then a function $L(t)=Lini*(1-\alpha(t/tmax))$ (luminance L changes with time t) is used to perform the luminance adjustment of the static image, where Lini is the initial luminance value of the image, and a is the decreasing coefficient set by the application requirement.

In an example, a display device contains an OLED display panel, and an electrical compensation unit which is used to perform electrical compensation on a display data deviation (for example, the display data deviation caused by a threshold voltage of a thin film transistor) of sub-pixel according to a reference signal captured in each sub-pixel of the OLED display panel. In this case, the luminance value adjusted by the controller 120 can be used by the electrical compensation unit for the calculation of the electrical compensation. For example, a luminance value adjusted by the controller 120 can be used as a target luminance value when a data voltage which should be output by the data drive circuit is calculated.

It should be noted that the words "unit" or "module" herein may refer to an application specific integrated circuit (ASIC), a processor and storage for performing one or more software or firmware program, an integrated logical circuit, and/or any other devices that can perform the above functions. In a simple embodiment, a device for controlling the controller can include a processor and a memory, while at least one unit in the controller can be implemented through executing program code stored in the memory by the processor. Of course, at least one unit in the controller can be implemented by using a pure circuit (for example, by using a logical operation circuit and a latch to perform required calculation and temporary storage functions), and can be combined with the units implemented by using software to form the controller, which is not limited in the embodiments of the present disclosure.

It should be noted that the processor stated herein can be, but is not limited to, an ASIC, a digital signal processor (DSP), a digital signal processing device (DSPD), a programmable logical device (PLD), a field programmable gate array (FPGA), a central processing unit (CPU), a micro control unit (MCU), a microcomputer, or a microprocessor.

Figure 4:
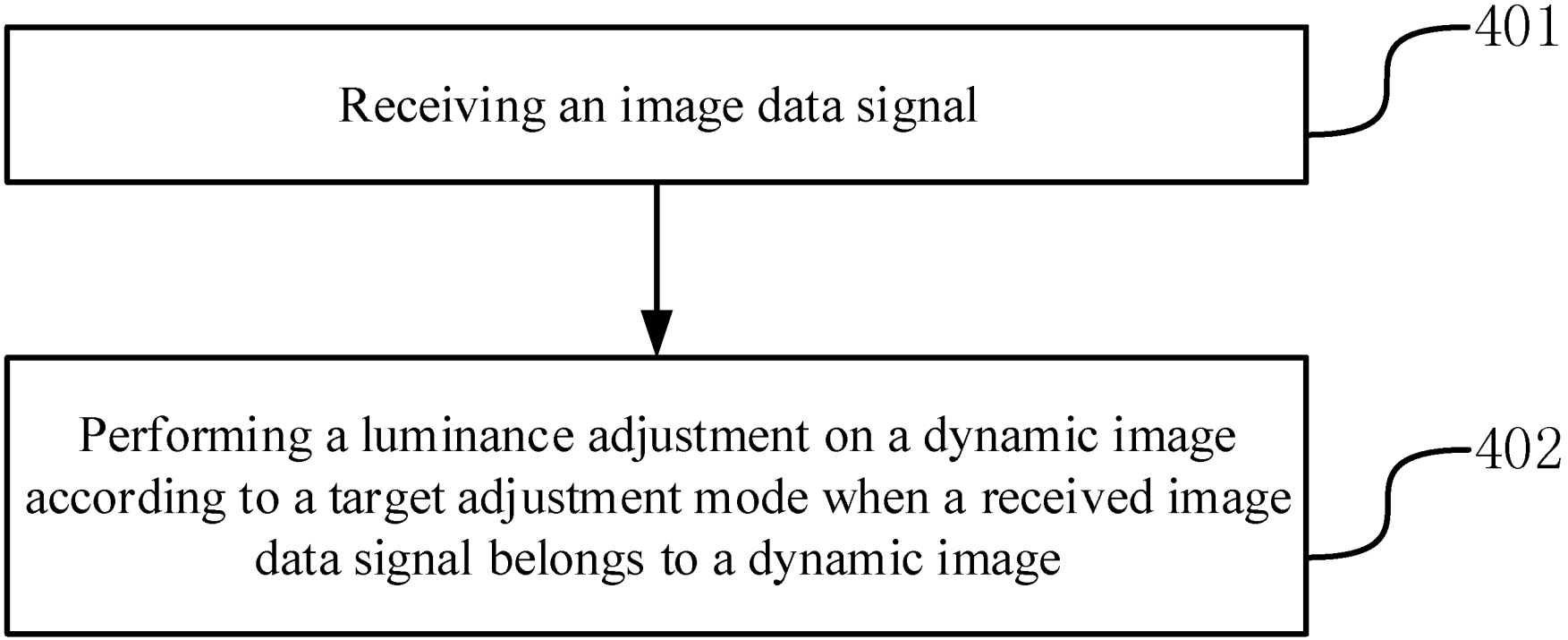
FIG. 4 is a flow chart of a luminance adjustment method according to an embodiment of the present disclosure.

FIG. 4 is a flow chart of a luminance adjustment method according to an embodiment of the present disclosure. Referring to FIG. 4, the luminance adjustment method includes following steps.

In step 401, an image data signal is received.

In step 402, a luminance adjustment is performed on a dynamic image according to a target adjustment mode when a received image data signal belongs to a dynamic image.

Herein, the target adjustment mode is an adjustment mode corresponding to a sum of luminance components in the image data signal among a plurality of adjustment modes. The plurality of adjustment modes comprise a first mode, a second mode and a third mode, and the corresponding sums of the luminance components respectively corresponding to the first mode, the second mode and the third mode sequentially increased. The range of luminance adjustment based on the first mode is larger than the range of luminance adjustment based on the second mode, and the range of luminance adjustment based on the second mode is smaller than the range of luminance adjustment based on the third mode.

It should be noted that the execution subject of the method in the embodiments may be a display device (any product or part with a display function, such as a display panel, a phone, a tablet computer, a TV, a display, a laptop computer, a digital photo frame, a navigator), an electronic part in a display device, which is not limited thereto. Here, the display device may be a liquid crystal display device, an OLED display device or a QLED display device, which is not limited thereto.

In a possible implementation, the luminance adjustment method further includes: performing the luminance adjustment on the static image according to a duration of displaying the static image when the received image data signal belongs to the static image, to make luminance of the static image decreases gradually with increase of the duration of displaying the static image.

In a possible implementation, the step of performing the luminance adjustment on a dynamic image according to the target adjustment mode when the received image data signal belongs to the dynamic image comprises: calculating a sum of the luminance components in the image data signal; and performing luminance adjustment on the dynamic image according to the target adjustment mode when the sum of the luminance components in the image data signal is different from the that in a previous frame.

In a possible implementation, the luminance adjustment method further includes: calculating the sum of the luminance components in the image data signal; and determining if the image data signal belongs to a static image or a dynamic image by judging whether the sum of the luminance components in the image data signal is the same as that in the previous frame.

In a possible implementation, the step of performing the luminance adjustment on a dynamic image according to the target adjustment mode when the received image data signal belongs to the dynamic image comprises: performing luminance adjustment on the dynamic image according to the target adjustment mode when the sum of the luminance components in the image data signal is different from that in the previous frame.

In a possible implementation, at least one of the plurality of adjustment modes uses a piecewise linear transformation method to perform luminance adjustment.

In a possible implementation, the step of performing luminance adjustment on the dynamic image according to the target adjustment mode comprises: performing luminance adjustment on the dynamic image by outputting control signal to gamma circuit.

In a possible implementation, the luminance adjustment based on the first mode increases the overall luminance, the luminance adjustment based on the second mode keeps the overall luminance unchanged, and the luminance adjustment based on the third mode decreases the overall luminance.

It should be understood that the presented descriptions already include examples of optional methods for implementing the luminance adjustment method in the embodiments. Also, the luminance adjustment method in the embodiments applies a smaller range of luminance adjustment to a dynamic image of medium luminance while applies a larger range of luminance adjustment to a dynamic image of lower or higher luminance, to reduce the image flickering in displaying a dynamic image that is dominated by a medium luminance. In this way, the display effect of the dynamic image can be improved.

Figure 5:
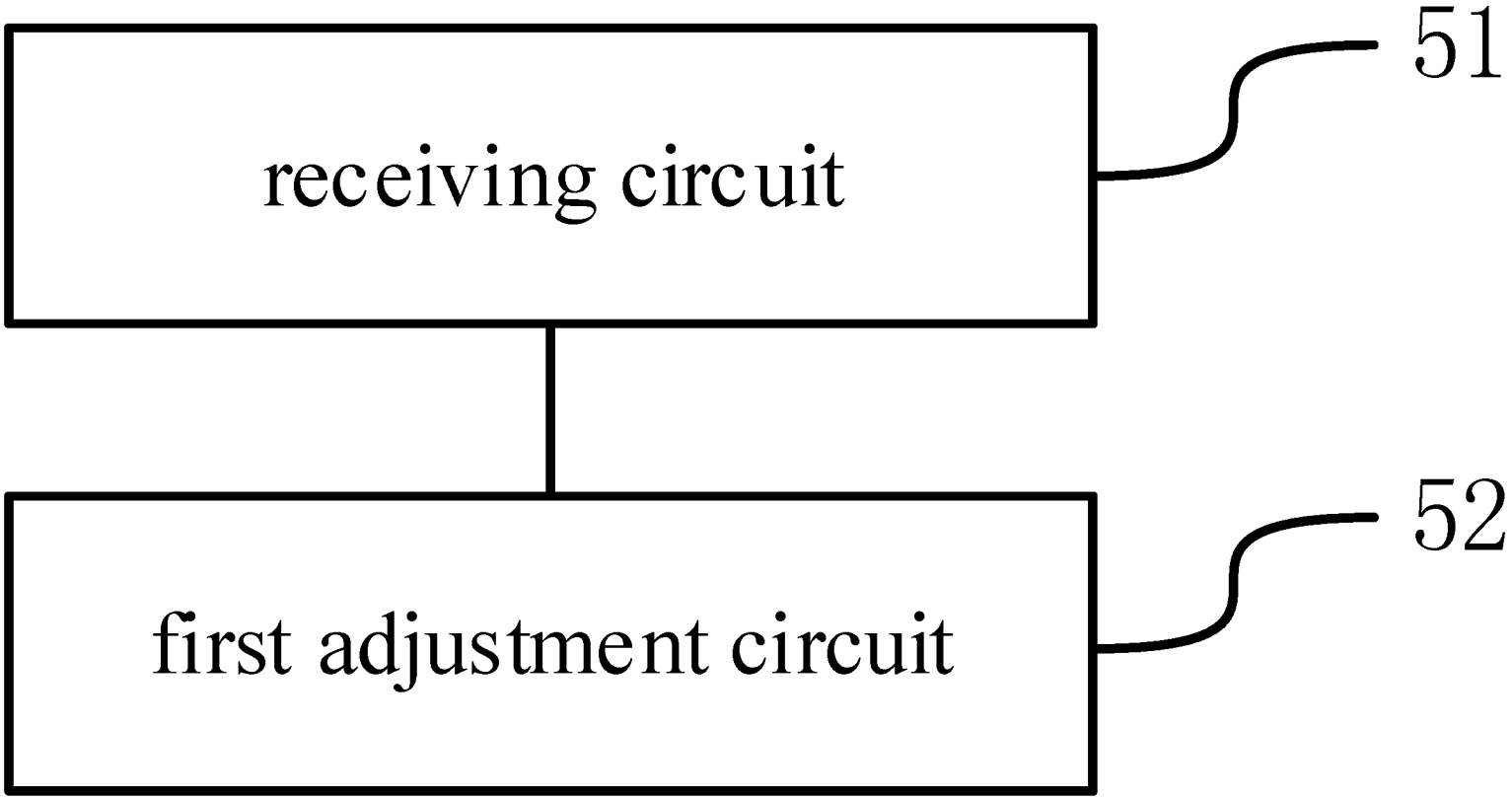
FIG. 5 is a block diagram of a structure of a luminance adjustment device according to an embodiment of the present disclosure.

FIG. 5 is a block diagram of a structure of a luminance adjustment device according to an embodiment of the present disclosure. Referring to FIG. 5, the luminance adjustment device includes:

a receiving circuit 51 configured to receive an image data signal; and a first adjustment circuit 52 configured to perform a luminance adjustment on a dynamic image according to a target adjustment mode when a received image data signal belongs to the dynamic image, wherein the target adjustment mode is an adjustment mode corresponding to a sum of luminance components in the image data signal among a plurality of adjustment modes, and the plurality of adjustment modes comprise a first mode, a second mode and a third mode, and the sums of the luminance components respectively corresponding to the first mode, the second mode and the third mode are sequentially increased;

a range of luminance adjustment based on the first mode is larger than the range of luminance adjustment based on the second mode, and the range of luminance adjustment based on the second mode is smaller than a range of luminance adjustment based on the third mode.

In a possible implementation, the luminance adjustment device further includes: a second adjustment circuit configured to perform the luminance adjustment on the static image according to a duration of displaying the static image when the received image data signal belongs to the static image, to make luminance of the static image decrease gradually with the increase of duration of displaying the static image.

In a possible implementation, the luminance adjustment device further includes: a calculating circuit configured to calculate the sum of the luminance components in the image data signal; and a determining circuit configured to determine whether the image data signal belongs to the static image or the dynamic image by judging whether the sum of the luminance components in the image data signal is the same as that in a previous frame.

In a possible implementation, the first adjustment circuit is further configured to: perform the luminance adjustment on the dynamic image according to the target adjustment mode when the sum of the luminance components in the image data signal is different from that in the previous frame.

It should be understood that the presented descriptions already contain examples of optional methods for implementing the luminance adjustment device in the embodiments. For example, the adjusting unit 122 shown in FIG. 2 achieves functions of the adjusting unit in the first and the second adjusting circuits in the embodiments. Also, the luminance adjustment device in the embodiments applies a smaller range of luminance adjustment to a dynamic image of medium luminance while applies a larger range of luminance adjustment to a dynamic image of lower or higher luminance, so as to reduce the image flickering in displaying a dynamic image that is dominated by the medium luminance. In this way, the display effect of the dynamic image can be improved.

In an embodiment shown in FIG. 5, a luminance adjustment device can be an application specific integrated circuit (ASIC), a processor and a storage for performing one or more software or firmware program, an integrated logical circuit, and/or any other devices that can perform the functions. In a simple embodiment, a device used for performing luminance adjustment can include a processor and a storage, while the receiving circuit 51 and the first adjusting circuit 52 are implemented through executing procedure code stored in the storage by the processor.

Another embodiment in the present disclosure includes a computer-readable storage medium which is used to store computer software instructions for luminance adjustment device shown in FIG. 5, and the instructions contains the procedures designed for implementing embodiments of the method. The luminance adjustment method provided in the present disclosure can be achieved by performing the stored procedures.

The foregoing descriptions are only exemplary embodiments of the present disclosure, and are not intended to limit the present disclosure. Within the spirit and principles of the disclosure, any modifications, equivalent substitutions, improvements, etc., are within the protection scope of the appended claims of the present disclosure.

What is claimed is:

1. A luminance adjustment method, comprising:

receiving an image data signal; and performing a luminance adjustment on a dynamic image according to a target adjustment mode when the received image data signal belongs to the dynamic image, wherein the target adjustment mode is an adjustment mode corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of luminance adjustment according to the first mode is larger than a range of luminance adjustment according to the second mode, and the range of luminance adjustment according to the second mode is smaller than a range of luminance adjustment according to the third mode.

2. The luminance adjustment method according to claim 1, further comprising:

calculating the sum of the luminance components in the image data signal; and determining whether the image data signal belongs to one of a static image and the dynamic image by judging whether the sum of the luminance components in the image data signal is the same as that in a previous frame.

3. The luminance adjustment method according to claim 2, wherein the performing the luminance adjustment on the dynamic image according to the target adjustment mode when the received image data signal belongs to the dynamic image, comprises:

performing the luminance adjustment on the dynamic image according to the target adjustment mode, when the sum of the luminance components in the image data signal is different from that in the previous frame.

4. The luminance adjustment method according to claim 1, further comprising:

performing the luminance adjustment on a static image according to a duration of displaying the static image when the received image data signal belongs to the static image, to make luminance of the static image decrease gradually with an increase of the duration of displaying the static image.

5. A non-transitory computer-readable storage medium storing instructions that, when executed by a computer, cause the computer to perform the method according to claim 4.

6. The luminance adjustment method according to claim 1, wherein at least one of the plurality of adjustment modes uses a piecewise linear transformation method to perform the luminance adjustment.

7. The luminance adjustment method according to claim 1, wherein the performing the luminance adjustment on the dynamic image according to the target adjustment mode comprises:

performing the luminance adjustment on the dynamic image by outputting a control signal to a gamma circuit.

8. The luminance adjustment method according to claim 1, wherein the luminance adjustment according to the first mode is a luminance adjustment for increasing the luminance, the luminance adjustment according to the second mode is a luminance adjustment for keeping the luminance unchanged, and the luminance adjustment according to the third mode is a luminance adjustment for decreasing the luminance.

9. A non-transitory computer-readable storage medium storing instructions that, when executed by a computer, cause the computer to perform the method according to claim 1.

10. A display device, comprising:

a display interface configured to receive an image data signal; and a controller connected to the display interface, wherein the controller is configured to:

perform a luminance adjustment to a dynamic image according to a target adjustment mode when a received image data signal belongs to the dynamic image, wherein the target adjustment mode is a luminance adjustment corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of the luminance adjustment according to the first mode is larger than a range of luminance adjustment according to the second mode, and the range of luminance adjustment according to the second mode is smaller than a range of luminance adjustment according to the third mode.

11. The display device according to claim 10, wherein the controller is configured to: perform the luminance adjustment on a static image according to a duration of displaying the static image when the received image data signal belongs to the static image, to make luminance of the static image decrease gradually with an increase of the duration of displaying the static image.

12. The display device according to claim 10, wherein the controller determines whether the image data signal belongs to one of a static image and the dynamic image by judging whether the sum of the luminance components in the image data signal is the same as that in a previous frame.

13. The display device according to claim 10, wherein at least one of the plurality of adjustment modes uses a piecewise linear transformation method to perform the luminance adjustment.

14. The display device according to claim 10, wherein the display device further comprises a gamma circuit connected to the controller, and the controller performs the luminance adjustment on the dynamic image by outputting a control signal to the gamma circuit.

15. The display device according to claim 10, wherein the luminance adjustment according to the first mode is a luminance adjustment for increasing the luminance, the luminance adjustment according to the second mode is a luminance adjustment for keeping the luminance unchanged, and the luminance adjustment according to the third mode is a luminance adjustment for decreasing the luminance.

16. The display device according to claim 10, wherein the display device further comprises a timing control circuit connected to the controller, and the controller receives a RGB data signal through the display interface and sends a EGBW data signal converted from the RGB data signal to the timing control circuit.

17. A luminance adjustment device, comprising:

a receiving circuit configured to receive an image data signal;

a first adjustment circuit configured to perform a luminance adjustment on a dynamic image according to a target adjustment mode when the received image data signal belongs to the dynamic image, wherein the target adjustment mode is an adjustment mode corresponding to a sum of luminance components in the image data signal among a plurality of adjustment modes;

wherein the plurality of adjustment modes comprise a first mode, a second mode and a third mode, and sums of the luminance components respectively corresponding to the first mode, the second mode and the third mode are sequentially increased; and a range of luminance adjustment according to the first mode is larger than a range of luminance adjustment according to the second mode, and the range of luminance adjustment according to the second mode is smaller than a range of luminance adjustment according to the third mode.

18. The luminance adjustment device according to claim 17, further comprising: a second adjustment circuit configured to perform the luminance adjustment on a static image according to a duration of displaying the static image when the received image data signal belongs to the static image, to make luminance of the static image decrease gradually with an increase of the duration of displaying the static image.

19. The luminance adjustment device according to claim 17, further comprising:

a calculating circuit configured to calculating the sum of the luminance components in the image data signal; and a determining circuit configured to determine whether the image data signal belongs to one of a static image and the dynamic image by judging whether the sum of the luminance components in the image data signal is the same as that in a previous frame.

20. The luminance adjustment device according to claim 17, wherein the first adjustment circuit is further configured to:

perform the luminance adjustment on the dynamic image according to the target adjustment mode, when a determining unit determines that the sum of the luminance components in the image data signal is different from that in the previous frame.

* * * * *